United States Patent [19]

Foshee et al.

[11] Patent Number: 4,779,908

[45] Date of Patent: Oct. 25, 1988

[54] LATCH BOLT DEADLOCKING MECHANISM

[75] Inventors: William R. Foshee, Noblesville; Lyn Hamel, Anderson, both of Ind.

[73] Assignee: Best Lock Corporation, Indianapolis, Ind.

[21] Appl. No.: 926,576

[22] Filed: Nov. 4, 1986

[51] Int. Cl.[4] ..... E05C 1/08

[52] U.S. Cl. ..... 292/163

[58] Field of Search ..... 292/163, 173, 337, 169.13, 292/169.14, 169.15, DIG. 60

[56] References Cited

U.S. PATENT DOCUMENTS

| | | | |
|---|---|---|---|
| 3,876,236 | 4/1975 | Best et al. | 292/169.13 |
| 4,318,558 | 3/1982 | Best et al. | 292/173 |
| 4,496,178 | 1/1985 | Best et al. | 292/169 |

*Primary Examiner*—Richard E. Moore

*Attorney, Agent, or Firm*—Barnes & Thornburg

[57] ABSTRACT

An improved latch bolt deadlocking mechanism includes a housing, a latch bolt, a deadlocking tumbler, and an auxiliary bolt. The latch bolt is movable along its longitudinal axis in the housing between projected and retracted positions. The deadlocking tumbler and the auxiliary bolt cooperate to selectively deadlock the latch bolt to retain the latch bolt in its projected position. The latch bolt is formed to include integral guides extending along the length of the latch bolt for guiding the auxiliary bolt along a straight path between a projected position holding the deadlocking tumbler in a release position to permit retraction of the latch bolt and a retracted position to permit movement of the deadlocking tumbler to its latch bolt-deadlocking position.

13 Claims, 2 Drawing Sheets

LATCH BOLT DEADLOCKING MECHANISM

BACKGROUND AND SUMMARY OF THE INVENTION

The present invention relates to latch bolt mechanisms, and particularly to latch bolt deadlocking mechanisms useful in both cylinder locks and tubular locks.

In certain known latch bolt mechanisms, the structure installed in the latch bolt for controlling the operation of the deadlocking tumbler includes several separate parts. For example, U.S. Pat. No. 4,318,558 to Best et al discloses such a structure having a first subassembly for releasing the deadlocking tumbler during retraction of the latch bolt. In addition, a separate second subassembly is provided for normally holding the deadlocking tumbler in a release position until the latch bolt is engaged in a strike plate upon closure of the door carrying the latch bolt mechanism. As shown best in FIGS. 6 and 9 of the Best et al '558 patent, the first subassembly includes a tailpiece 70 and a cam member 84, while the second subassembly includes an auxiliary bolt 50 and a release cam 108.

One object of the present invention is to reduce the number of separate parts needed to control the operation of a deadlocking tumbler, thereby reducing the cost of manufacturing and increasing the operating life of the control mechanism.

According to the present invention, an improved latch bolt deadlocking assembly is provided. The assembly includes a housing, an elongated latch bolt movable along its longitudinal axis in the housing between projected and retracted positions, and control means for selectively deadlocking the latch bolt to retain the latch bolt in its projected position. The control means is movable between a deadlocking position blocking movement of the latch bolt toward its retracted position and a release position permitting movement of the latch bolt toward its retracted position. The latch bolt is formed to include guide means extending along the length of the latch bolt for guiding the control means during movement between its deadlocking and release positions.

In preferred embodiments, the control means includes a deadlocking tumbler and an auxiliary bolt. The deadlocking tumbler is movable relative to the latch bolt between a first position deadlocking the latch bolt to retain the latch bolt in its projected position and a second position releasing the latch bolt to permit movement of the latch bolt toward its retracted position. The auxiliary bolt controls the position of the deadlocking tumbler. In operation, the auxiliary bolt slides on the latch bolt in a direction substantially parallel to the longitudinal axis of the latch bolt between a projected position holding the deadlocking tumbler in its second position and a retracted position permitting movement of the deadlocking tumbler to its first position.

The latch bolt includes forward and rearward sections which cooperate to provide the guide means. Shallow groove means is formed in the forward section of the latch bolt and configured to slidably receive and support the auxiliary bolt in its projected position. A spaced-apart pair of guide walls is provided in the rearward section and configured to slidably receive and support the auxiliary bolt in its retracted position. The forward ends of the guide walls are desirably connected to the rearward end of the shallow groove means. Illustratively, the guide walls are symmetrically beveled to converge toward the longitudinal axis of the latch bolt so that the auxiliary bolt is received and supported therebetween.

Also in preferred embodiments, the assembly further includes a tailpiece coupled to the latch bolt for selectively moving the latch bolt from its projected position to its retracted position. The auxiliary bolt desirably includes integral first cam means for holding the deadlocking tumbler in its release position while the auxiliary bolt is in its projected position. In addition, the tailpiece desirably includes integral second cam means for moving the deadlocking tumbler from its deadlocking position to its release position during retraction of the tailpiece.

One feature of the present invention is the formation of the latch bolt to include integral guide means extending along the length of the latch bolt for guiding the control means during movement of its deadlocking and release positions. In particular, the guide means guides the auxiliary bolt along a straight path as it moves between projected and retracted positions. As noted above, the auxiliary bolt controls the position of the deadlocking tumbler. In contrast to known latch bolt mechanisms, the novel configuration of the latch bolt itself provides the means for guiding and supporting the slidable auxiliary bolt. Such a feature advantageously reduces the number of parts needed to operate the deadlocking tumbler.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
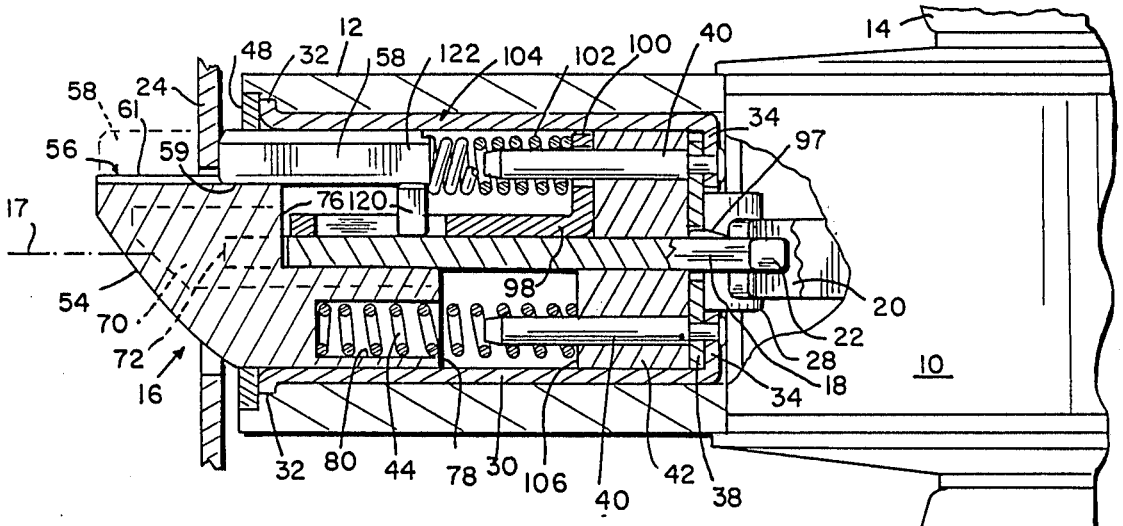
FIG. 1. is a top view of a latch bolt deadlocking mechanism of the present invention, with portions broken away, showing a latch bolt in its projected position and an auxiliary bolt in its retracted position.

The latch tube assembly shown in FIG. 1 comprises a cylinder lock chassis 10 mounted in a cross bore in a door 12 and provided with two opposite knobs 14. The assembly also includes a novel latch bolt 16 having a longitudinal axis 17 and a tailpiece 18 for retracting the latch bolt 16.

The chassis 10 contains a bolt retractor 20 operated by the knobs 14 and including forward jaws for engaging a cross bar 22 at the rear of the tailpiece 18 of the latch tube assembly. The jaws act to retract the tailpiece 18 and the latch bolt 16. The latch bolt 16 is adapted to engage a strike plate 24 mounted in a door jamb as shown in FIG. 1.

Figure 3:
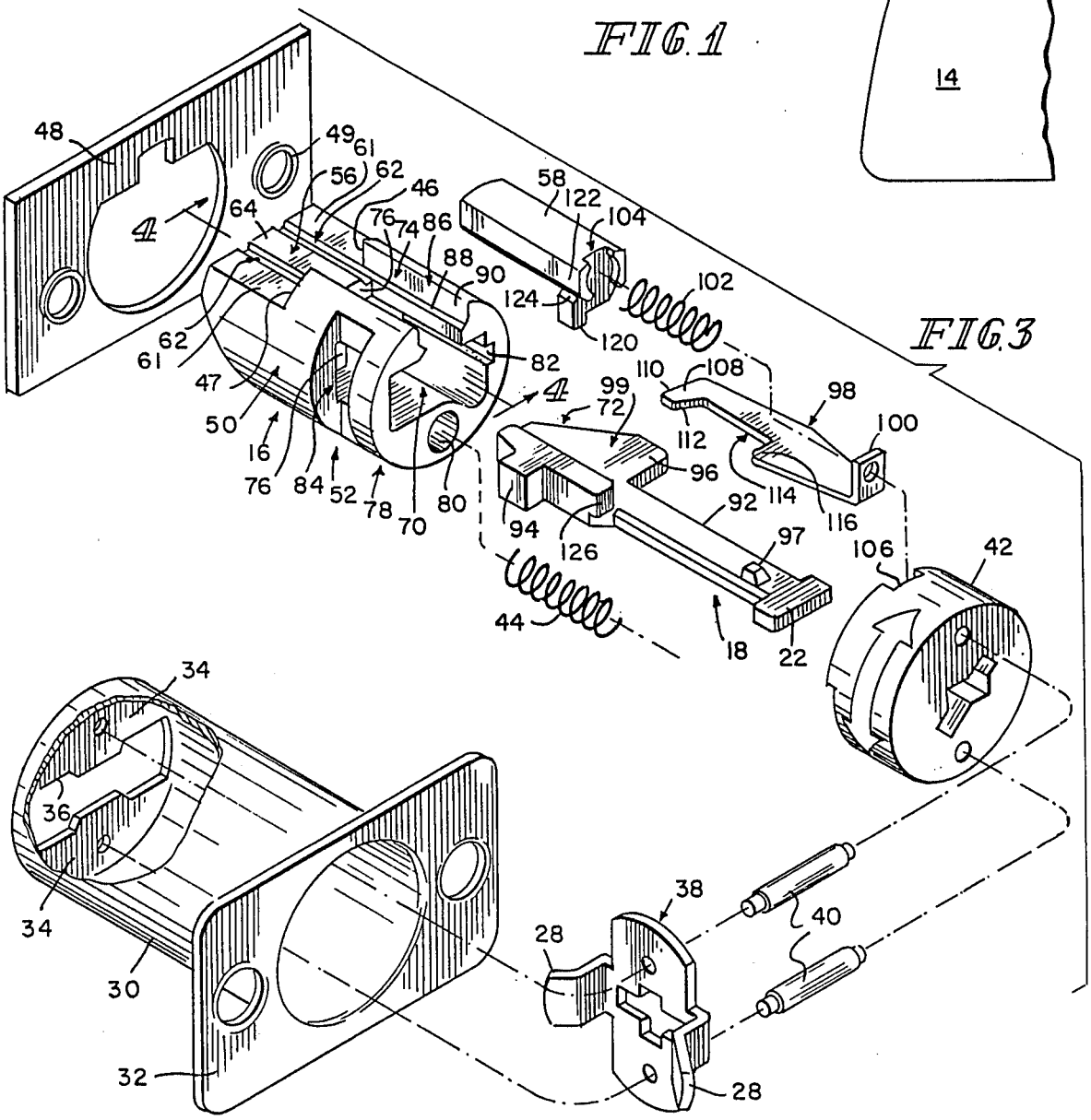
FIG. 3 is an exploded view showing the assembly of the mechanism illustrated in FIG. 1.

The latch tube assembly comprises a tubular housing 30 formed with an out-turned rectangular flange 32 at its forward end and having rear wall segments 34 which define a generally rectangular diametric opening 36 shown in FIG. 3. A back plate 38 is seated against the end wall segments 34 and carries prongs 28 which engage the chassis 10. The back plate 38 is riveted to the segments 34 by rivets integral with spring guide pins 40. A guide block 42 is mounted over those pins 40 and against the back plate 38.

The latch bolt 16 is slidably mounted in the front end of the tube housing 30 and spring-pressed forward by a spring 44. Latch bolt 16 is stopped in a projected position by engagement of stop shoulders 46 and 47 with a face plate 48. The face plate 48 is fixed to the front flange 32 by integral hollow rivets formed about the mounting screw holes 49.

Figure 2:
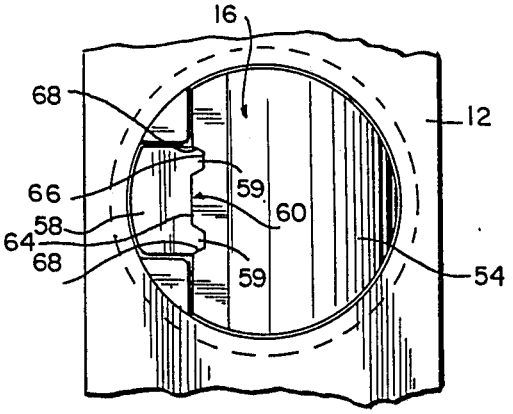
FIG. 2 is an end elevation view of the mechanism illustrated in FIG. 1 showing the latch bolt and the adjacent auxiliary bolt mounted in a door.

Latch bolt 16 includes a forward portion 50 and a rearward portion 52. The forward portion 50 includes a beveled front face 54 for engaging strike plate 24 during closing of door 12 and a forward guide section 56 for supporting an auxiliary bolt 58 in its projected position shown in FIGS. 1, 2, and 4. Auxiliary bolt 58 includes a pair of spaced-apart parallel rails 59 extending away from bottom surface 60 as shown in FIG. 2.

The forward guide section 56 includes a flat face 61 and a pair of elongated, spaced-apart parallel grooves 62 separated by an elongated ridge 64. Desirably, each groove 62 has an opening in flat face 61 to slidably receive rails 59 of auxiliary bolt 58 and is defined by a bottom wall 64 and a pair of splayed side walls 68 as shown best in FIG. 2. In the illustrated embodiment, bottom surface 60 slidably engages upstanding ridge 64 during a portion of its travel to improve lateral stability of auxiliary bolt 58 during movement. It is also within the scope of the present invention to omit ridge 64 and slidably receive auxiliary bolt 58 in a single, wide, shallow groove (not shown) having straight, arcuate, or beveled side walls.

Figure 5:
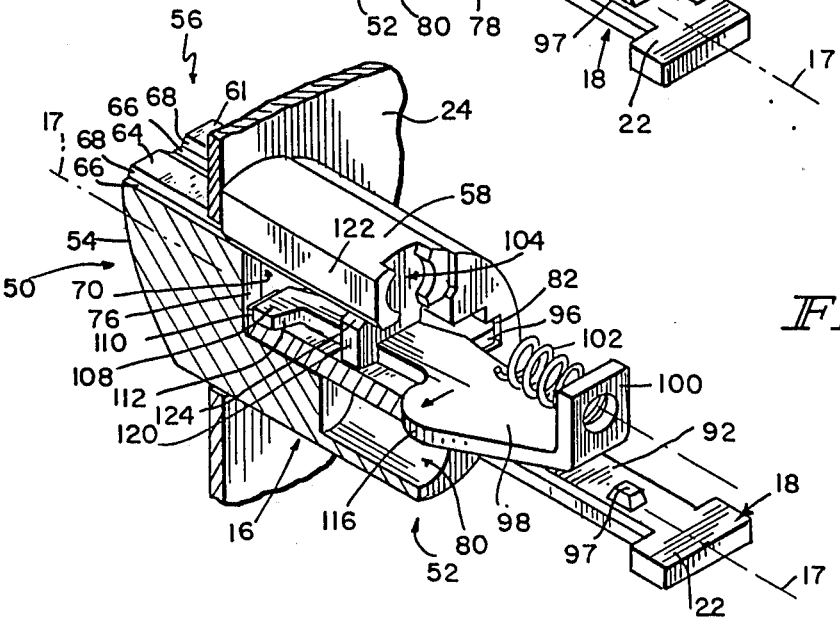
FIG. 5 is a sectional view similar to FIG. 4 but showing the deadlocking tumbler in its deadlocking position.

The rearward portion 52 of latch bolt 16 includes a central cavity 70 formed to receive the forward end 72 of tailpiece 18 in coupling relation. The rearward portion 52 also includes a rearward guide section 74 for guiding and supporting the auxiliary bolt 58 in its retracted position above the open cavity 70 as shown in FIG. 5. Central cavity 70 is of generally rectangular cross-section and is bordered at one end by abutment face 76. Adjacent to the rearward guide section 74, the latch bolt 16 has a rearwardly-extending skirt portion 78 of generally circular cross-section but with a number of interruptions. These include a rearwardly-opening bore 80 forming a seat for spring 44, and edge slot 82, and an opposite window 84. The edge slot 82 and the opposite window 84 cooperate to retain the forward end 72 of the tailpiece 18 in the central cavity 70 of the latch bolt 16 in the manner described below.

Rearward guide section 74 includes a pair of elongated, spaced-apart guide walls 86 having bottom portions 88 beveled to converge toward the longitudinal axis 17 of the latch bolt 16. Each guide wall 86 further includes an upstanding flat side portion 90. The guide walls 86 are separated by a space communicating with central cavity 70. The guide walls 86 are aligned to orient the flat side portions 90 in substantially spaced-apart parallel relation and to orient the bottom portions 88 in splayed relation to the longitudinal axis 17 of the latch bolt 16. The guide walls 86 slidably receive and support the auxiliary bolt 58 therebetween as a result of this novel configuration.

The latch bolt 16 is connected to the bolt retractor 20 of the cylinder lock by the tailpiece 18. Tailpiece 18 lies flat in the central vertical plane of the latch tube assembly as shwon in FIG. 1. The tailpiece 18 includes the rear cross bar 22, a straight-sided guidable portion 92 extending forward thereform, and a forward end 72 which extends into the cavity 70 of the latch bolt 16. The forward end 72 of tailpiece 18 has a latch bolt-retracting arm 94 for engagement in the window 84 of the latch bolt 16 and a support arm 96 which extends oppositely into engagement with the edge slot 82 formed in the latch bolt 16. A boss 97 is provided on guidable portion 92 adjacent rear cross bar 22 to provide means for stopping forward motion of tailpiece 18 against guide block 42 in the fully projected position of the latch bolt 16.

A deadlocking tumbler 98 is mounted in the tubular housing 30 with its forward portion against the front face 99 of the tailpiece 18 by means of an out-turned foot 100 received over one of the spring guide pins 40. A coil spring 102 is installed between the foot 100 of the deadlocking tumbler 98 and a rearwardly-facing, spring-receiving portion 104 of auxiliary bolt 58. Spring 102 biases auxiliary bolt 58 to its projected position and also biases deadlocking tumbler 98 against the front face 106 of the guide block 42. As shown best in FIG. 3, deadlocking tumbler 98 further includes a blocker nose 108 having a front blocker face 110 and a rear cam face 112. Behind the cam face 112, the deadlocking tumbler 98 is formed to include a wide undercut relief 114 and an adjacent cam nose 116. Reference is hereby made to U.S. Pat. No. 4,318,558 to Best et al. for a description of a suitable deadlocking tumbler.

Auxiliary bolt 58 is configured and movable to control the position of deadlocking tumbler 98. In particular, auxiliary bolt 58 operates to permit movement of the spring-loaded deadlocking tumbler 98 from its release position shown in FIG. 4 to its deadlocking position shown in FIG. 5 during retraction of auxiliary bolt 58 as door 12 is closed. Auxiliary bolt 58 includes an integral cam finger 120 depending from its rear end 122 in offset relation to the spring-receiving portion 104. As shown best in FIG. 3, a notch 124 is formed between one side of the rear end 122 and the depending cam finger 120 to provide means for slidably receiving one of the bottom portions 88 of guide walls 86. As shown best in FIG. 4, the cam finger 120 operates to hold the spring-biased deadlocking tumbler 98 in a release position wherein the blocker nose 108 of tumbler 98 is held in central cavity 70 in a position away from abutment face 76. In such a release position, the deadlocking tumbler 98 does not obstruct rearward movement of latch bolt 16 during either closing of door 12 or operation of bolt retractor 20 by rotatable door knob 14. The integral cam finger 120 is retained in this tumbler-holding position as long as the auxiliary bolt 58 remains in its projected position.

Figure 4:
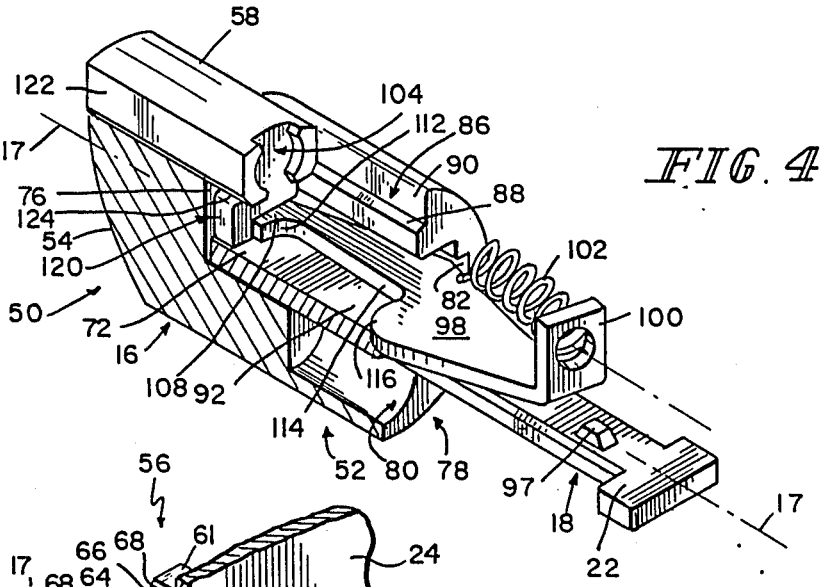
FIG. 4 is a sectional view taken along lines 4—4 of FIG. 3 showing the deadlocking tumbler in its release position.

Movement of projected auxiliary bolt 58 toward its retracted position in rearward guide section 74 of latch bolt 16 as shown in FIG. 5 allows the spring-biased deadlocking tumbler 98 to move from its release position shown in FIG. 4 to its deadlocking position shown in FIG. 5. As soon as cam finger 120 is moved into undercut 114, deadlocking tumbler 98 pivots about its foot 100 in a direction moving front blocker face 110 into a new position in confronting relation to abutment face 76 of latch bolt 16. In such a deadlocking position, tumbler 98 blocks substantial rearward movement of latch bolt 16 into tubular housing 30.

The tailpiece 18 is also configured to aid in controlling the position of deadlocking tumbler 98, and, in particular, the return of deadlocking tumbler 98 to its release position. Specifically, tailpiece 18 operates to move deadlocking tumbler 98 from its deadlocking position shown in FIG. 5 to its release position shown in FIG. 4 during movement of auxiliary bolt 58 from its retracted position to its projected position as door 12 is opened. Tailpiece 18 includes an integral, upstanding, rearwardly-facing cam member 126 positioned adjacent to one side of guidable portion 92 as shown best in FIG. 3.

Cam member 126 actuates deadlocking tumbler 98 in the following manner. Tailpiece 98 is retracted by bolt retractor 20 upon operation of door knobs 14. During retraction, cam member 126 engages cam nose 116 on deadlocking tumbler 98 and pivots tumbler 98 against the biasing force provided by coil spring 102 to its release position, thereby permitting continued rearward movement of latch bolt 16 past the front blocker face 110 of deadlocking tumbler 98. Reference is again made to U.S. Pat. No. 4,318,558 to Best et al. for a description of conventional clearances that are desirably provided between the latch bolt 16 and the deadlocking tumbler 98 and also between the front face of window 84 and arm 94 to permit rearward lost motion of latch bolt 16 relative to tailpiece 18. Such lost motion is sufficient to permit camming engagement of cam member 126 and cam nose 116 during retraction of tailpiece 18.

The latch bolt 16 and the auxiliary bolt 58 are preferably brass powder metal parts. These powder metal parts advantageously increase manufacturing efficiency by reducing the number of secondary operations generally needed to rework conventional brass die castings, decrease costs, and provide better surface finish. In the preferred embodiment, two secondary milling operations were used to provide the flat surface on front face 61 and 64 and also to expose the window 84 in latch bolt 16.

The formation of latch bolt 16 to include a rearward guide section 74 for supporting slidable auxiliary bolt 58 in its retracted position provides many advantages over conventional deadlocking latch mechanisms. Conventional separate guide and support members, typically attached to each of the tailpiece and the auxiliary bolt, are no longer required due to the provision of the integral guide means in latch bolt 16 itself. Reduction in the number of parts included in the deadlocking latch mechanism of the present invention advantageously reduces the cost of manufacturing the mechanism. In addition, such a mechanism is readily adaptable to use of powder metal components instead of conventional brass die castings. Use of powder metal components improves part quality and assembly, reduces tool wear, and decreases the amount of rework necessary at assembly. Additional cost savings can be realized as a result.

Although the invention has been described in detail with reference to certain embodiments, variations and modifications exist within the scope and spirit of the invention as described and as defined in the following claims.

What is claimed is:

1. A latch bolt assembly comprising a housing, an elongated latch bolt movable along its longitudinal axis in the housing between projected and retracted positions, the latch bolt including a forward guide section formed to include groove means for slidably receiving an auxiliary bolt and a rearward guide section including a spaced-apart pair of separate guide walls beveled to converge toward the longitudinal axis of the bolt and define a longitudinally extending space therebetween, the guide walls being aligned with the groove means to provide a substantially straight path through the latch bolt for controlling movement of an auxiliary bolt on the latch bolt, the straight path being aligned in substantially parallel relation to the longitudinal axis of the latch bolt, a deadlocking tumbler movable relative to the latch bolt between a first position deadlocking the latch bolt to retain the latch bolt in its projected position and a second position releasing the latch bolt to permit movement of the latch bolt toward its retracted position, and an auxiliary bolt for controlling the position of the deadlocking tumbler, the auxiliary bolt sliding on the latch bolt along the straight path provided by the groove means and the guide walls between a projected position on the forward guide section holding the deadlocking tumbler in its second position and a retracted position on the rearward guide section permitting movement of the deadlocking tumbler to its first position.

2. The assembly of claim 1, wherein the auxiliary bolt includes integral first cam means for holding the deadlocking tumbler in its second position while the auxiliary bolt is in its projected position, and further comprising a tailpiece coupled to the latch bolt for selectively moving the latch bolt from its projected position to its retracted position, the tailpiece including integral second cam means for moving the deadlocking tumbler from its first position to its second position during retraction of the tailpiece.

3. In a latch bolt deadlocking mechanism of the type including a housing, an elongated latch bolt movable along its longitudinal axis in the housing between projected and retracted positions, the latch bolt including forward and rearward ends and stop means intermediate the forward and rearward ends for limiting movement of the latch bolt and of the housing, a deadlocking tumbler movable relative to the latch bolt between a first position deadlocking the latch bolt to retain the latch bolt in its projected position and a second position releasing the latch bolt to permit movement of the latch bolt toward its retracted position, and an auxiliary bolt for controlling the position of the deadlocking tumbler, the auxiliary bolt sliding on the latch bolt in a working direction substantially parallel to the longitudinal axis of the latch bolt between a projected position holding the deadlocking tumbler in its second position and a retracted position permitting movement of the deadlocking tumbler to its first position, the improvement comprising guide means integral with the latch bolt for supporting the auxiliary bolt for sliding movement in said working direction between said projected and retracted positions, the guide means extending along the length of the latch bolt to control lateral movement of the auxiliary bolt relative to the latch bolt during sliding movement of the auxiliary bolt in its working direction, the guide means being provided by a forward guide section extending substantially between the forward end of the latch bolt and the stop means and a rearward guide section extending substantially between the stop means and the rearward end of the latch bolt, the forward section being defined by at least one shallow groove formed in the latch bolt and configured to slidably receive and support the auxiliary bolt in its projected position, and the rearward section being defined by a pair of spaced-apart parallel guide walls configured to slidably receive and support the auxiliary bolt in its retracted position, the guide walls being symmetrically beveled to converge toward the longitudinal axis of the latch bolt.

4. The improvement of claim 3, further comprising a tailpiece coupled to the latch bolt for selectively moving the latchbolt from its projected position to its retracted position, the tailpiece including integral cam means for engaging the deadlocking tumbler during retraction of the tailpiece to move the deadlocking tumbler from its first position deadlocking the latch bolt to its second position releasing the latch bolt.

5. The improvement of claim 3, wherein the auxiliary bolt includes integral cam means for holding the deadlocking tumbler in its second position releasing the latch bolt while the auxiliary bolt is in its projected position.

6. In a latch bolt deadlocking mechanism of the type including a housing, an elongated latch bolt movable along its longitudinal axis in the housing between projected and retracted positions, the latch bolt including forward and rearward ends and stop means intermediate the forward and rearward ends for limiting movement of the latch bolt and of the housing, a deadlocking tumbler movable relative to the latch bolt between a first position deadlocking the latch bolt to retain the latch bolt in its projected position and a second position releasing the latch bolt to permit movement of the latch bolt toward its retracted position, and an auxiliary bolt for controlling the position of the deadlocking tumbler, the auxiliary bolt sliding on the latch bolt in a working direction substantially parallel to the longitudinal axis of the latch bolt between a projected position holding the deadlocking tumbler in its second position and a retracted position permitting movement of the deadlocking tumbler to its first position, the improvement comprising guide means integral with the latch bolt for supporting the auxiliary bolt for sliding movement in said working direction between said projected and retracted positions, the guide means extending along the length of the latch bolt to control lateral movement of the auxiliary bolt relative to the latch bolt during sliding movement of the auxiliary bolt in its working direction, the guide means being provided by a forward guide section extending substantially between the forward end of the latch bolt and the stop means and a rearward guide section extending substantially between the stop means and the rearward end of the latch bolt, the forward guide section being configured to extend outside of the housing when the latch bolt is in its projected position and the rearward guide section being configured to remain inside the housing when the latch bolt is in its retracted position, the rearward guide section being configured to provide support means for supporting the auxiliary bolt in its retracted position, the support means including a pair of spaced-apart parallel guide walls having bottom portions that are symmetrically beveled to converge toward the longitudinal axis of the latch bolt so that the auxiliary bolt is received and supported therebetween.

7. A latch bolt assembly comprising a housing, an elongated latch bolt movable along its longitudinal axis relative to the housing between projected and retracted positions, deadlocking means for deadlocking the latch bolt to retain the latch bolt in a projected position, control means for selectively actuating the deadlocking means, the control means including an elongated auxiliary bolt movable on the latch bolt relative to the housing between projected and retracted positions, the latch bolt being formed to include guide means extending along the length of the latch bolt for slidably receiving the auxiliary bolt during movement of the auxiliary bolt between its projected and retracted positions, the guide means being configured to support the entire length of the auxiliary bolt in its retracted position to stabilize the position of the auxiliary bolt relative to the deadlocking means while the auxiliary bolt occupies its retracted position, the auxiliary bolt including cam means for holding the deadlocking means in a latch bolt-releasing position, the guide means including a pair of guide walls aligned in spaced-apart relation to engage the auxiliary bolt and define a longitudinally extending space therebetween for receiving the cam means during movement of the auxiliary bolt between its projected and retracted positions, the guide walls being symmetrically beveled to converge toward the longitudinal axis of the latch bolt.

8. A latch bolt assembly comprising a housing, an elongated latch bolt movable along its longitudinal axis relative to the housing between projected and retracted positions, the latch bolt including forward and rearward sections, a deadlocking tumbler movable relative to the latch bolt between deadlocking and release positions, and an auxiliary bolt movable on the latch bolt relative to the housing between projected and retracted positions to control actuation of the deadlocking tumbler, the latch bolt being formed to include guide means extending along the length of the latch bolt for slidably receiving the entire length of the auxiliary bolt during movement of the auxiliary bolt between its projected and retracted positions, the guide means being provided by groove means formed in the forward section and a space-apart pair of guide walls formed in the rearward section and beveled to converge toward the longitudinal axis of the latch bolt, the longitudinally forward groove means and the longitudinal rearward guide walls cooperating to define a substantially straight, continuous guided rail supporting the auxiliary bolt during movement of the auxiliary bolt between its projected and retracted positions to stabilize the position of the auxiliary bolt on the latch bolt relative to the deadlocking tumbler.

9. The assembly of claim 8, wherein the auxiliary bolt includes cam means for holding the deadlocking tumbler in its release position while the auxiliary bolt is in its projected position and the spaced-apart guide walls are aligned to define therebetween an opening receiving the cam means upon movement of the auxiliary bolt to its projected position.

10. The assembly of claim 8, wherein the auxiliary bolt includes integral first cam means for holding the deadlocking tumbler in its release position while the auxiliary bolt is in its projected position, and further comprising a tailpiece coupled to the latch bolt for selectively moving the latch bolt from its projected position to its retracted position, the tailpiece including integral second cam means for moving the deadlocking tumbler from its deadlocking position to its release position during retraction of the tailpiece.

11. A deadlocking mechanism for a latch bolt, the mechanism comprising a deadlocking tumbler, means for supporting the deadlocking tumbler for movement between a latch bolt-deadlocking and a latch bolt-releasing position, control means for controlling the position of the deadlocking tumbler, the control means including an auxiliary bolt including a bottom wall having a forward portion and a rearward portion, a bottom wall, and cam means depending from the rearward portion of the bottom wall of the auxiliary bolt for holding the deadlocking tumbler in its latch bolt-releasing position, the latch bolt being formed to provide support means for slidably receiving the bottom wall of the auxiliary bolt to permit sliding movement of the auxiliary bolt on the latch bolt between a projected position arranging the cam means to hold the deadlocking tumbler in its latch bolt-releasing position and a retracted position arranging the cam means to permit the deadlocking tumbler to move to its latch bolt-deadlocking position, the support means being configured to support at least the rearward portion of the bottom wall of the auxiliary bolt upon movement of the auxiliary bolt to its retracted position so that the stability of the position of the auxiliary bolt relative to the deadlocking tumbler is enhanced while the auxiliary bolt is in its retracted position.

12. The mechanism of claim 11, wherein the support means includes a spaced-apart pair of guide walls engaging a portion to the bottom wall during movement of the auxiliary bolt between its projected and retracted positions, and the latch bolt is formed to include slot means intermediate the spaced-apart pair of guide walls for receiving the cam means upon movement of the auxiliary bolt to its projected position.

13. The mechanism of claim 12, wherein the guide walls are configured to position the cam means therebetween in the slot means upon movement of the auxiliary bolt to its retracted position.

* * * * *